US012643003B2

(12) United States Patent
Neely

(10) Patent No.: US 12,643,003 B2
(45) Date of Patent: Jun. 2, 2026

(54) EXERCISE GLOVE

(71) Applicant: Thomas Neely, East Stroudsburg, PA (US)

(72) Inventor: Thomas Neely, East Stroudsburg, PA (US)

( * ) Notice: Subject to any disclaimer, the term of this patent is extended or adjusted under 35 U.S.C. 154(b) by 0 days.

(21) Appl. No.: 18/392,899

(22) Filed: Dec. 21, 2023

(65) Prior Publication Data

US 2024/0207668 A1 Jun. 27, 2024

Related U.S. Application Data

(60) Provisional application No. 63/434,748, filed on Dec. 22, 2022.

(51) Int. Cl.
*A63B 21/00* (2006.01)
*A63B 21/04* (2006.01)
*A63B 21/055* (2006.01)

(52) U.S. Cl.
CPC ..... *A63B 21/4019* (2015.10); *A63B 21/0442* (2013.01); *A63B 21/0552* (2013.01)

(58) Field of Classification Search
CPC ..... A63B 21/4019; A63B 21/0442; A63B 21/0552; A63B 2225/09; A63B 21/0557; A63B 23/16; A63B 21/4025
See application file for complete search history.

(56) References Cited

U.S. PATENT DOCUMENTS 5,373,585 A * 12/1994 Wiggins ..... A63B 21/4019 2/163
5,538,488 A * 7/1996 Villepigue ..... A63B 21/023 601/40
5,697,103 A * 12/1997 Wiggins ..... A41D 19/0034 2/163
7,163,308 B2 * 1/2007 Ferrari ..... G08B 5/004 2/160
7,415,735 B2 * 8/2008 Erickson ..... A41D 19/01582 2/163
8,491,447 B1 * 7/2013 Koranic ..... A63B 23/16 482/44
10,646,749 B1 * 5/2020 Williams ..... A63B 23/16
2012/0065026 A1 * 3/2012 Land ..... A63B 21/4019 482/47

* cited by examiner

*Primary Examiner* — Andrew M Kobylarz
(74) *Attorney, Agent, or Firm* — Benjamin Appelbaum

(57) ABSTRACT

Embodiments of the present invention comprise a glove with a connecting member (a ring) at the glove's palm and back for connecting the glove to a resistance device or exercise machine. One or more adjustment straps and retention bands attached to the fingers, provide a secure fit, and retain a finger connecting member therein. The finger connecting members form a loop, pass through a d-ring attached to each finger, and the loops attach to the ring. The ends of the connecting members are attached near the finger tip, which is covered by a cap. An adjustable cuff near the wrist enables the user to fasten the glove securely. When connected to a resistance device or exercise machine, the glove helps to increase connectivity and transfer force through the hands and fingers.

14 Claims, 6 Drawing Sheets

EXERCISE GLOVE

CROSS-REFERENCE TO RELATED APPLICATIONS

This application claims the benefit of U.S. provisional patent application Ser. No. 63/434,748, filed 22 Dec. 2022, by the present inventor, and whose contents are incorporated by reference herein in their entirety.

FIELD OF THE INVENTION

Embodiments of the present invention are utilized for exercising, particularly in the areas of resistance, strength, weight, and flexibility and mobility training. An embodiment of the present invention comprises a glove that is worn on the hand of a user (also referred to as a trainee) and which includes a mechanism for attaching the glove to an exercise device, such as a resistance device or an exercise machine. The palm side of the glove, or the back side of the glove, or both, have a plurality of finger connecting members, which are attached to each finger, and are joined at a ring. Each finger of the glove includes a finger connecting member, which is attached to the finger proximate the finger tip, and retained by a cap. Each finger also includes one or more fasteners and one or more retention bands, which slidably retain the finger connecting member. The ring receives a fastener of a resistance device, and connects the glove to the resistance device, for use in a variety of exercises. The use of the glove aids in exercise, by increasing the connectivity and transfer of force from an exercise device through the hands and fingers. Examples of exercises are included to describe uses of the glove of the present invention.

BACKGROUND OF THE INVENTION

Numerous exercises have been developed that employ weights as a means of strength or resistance training. The weights have typically been hand-held weights, such as dumbbells. Various types of exercise machines have been developed, and which can be used for a wide variety of exercises. These machines commonly include one or more stacks of weights, and generally the weight utilized for a particular exercise is adjusted by selecting the desired weights from such a stack. Instead of holding the weight in one's hand, such as done with a dumbbell, the user grips a handle which is connected to the selected weights by a rope, cable, elastic strap, or similarly functional material. For exercises involving resistance, where weight is not a concern, items such as a door, wall, fence, or another fixed object, can be used for resistance training, generally using a rope, cable, elastic strap, or similarly functional material grasped by the user.

In recent years, there has been an increased interest in maintaining physical fitness, and the development of various types of exercise devices has led to the creation of more and various types of exercises for most muscles of the human body.

Among the exercises for strengthening muscles in the upper body, exemplary exercises include the chest fly and the reverse fly. The chest fly targets muscles of the chest (pectorals) and the upper arm (biceps and deltoid), while the reverse fly targets muscles of the upper back (including the rhomboids, trapezius and posterior deltoids). The chest fly has commonly been performed with dumbbells and with the user lying on their back. When using an exercise machine instead of dumbbells for the chest fly, the individual usually stands upright and faces away from the machine. For the reverse fly, the individual is facing the machine. The individual grasps either a strap or a handle, which is connected to the selected weights of the machine, and performs the exercise for the desired number of repetitions. The exercise apparatus of the present invention is designed to keep the hand open and transfer force directly into the hands and fingers while performing movements such as but not limited to the chest fly and reverse fly. Embodiments of the present invention can also be used in a wide variety of exercises.

BRIEF SUMMARY OF THE INVENTION

An object of the present invention is to provide an apparatus to keep a user's hand open and transfer force directly to the hands and fingers while engaging in exercises such as resistance, strength training, weight training, and/or flexibility and mobility training.

Another object of the present invention is to provide a glove that can be secured on a user's hand at multiple points along the fingers.

Another object of the present invention is to provide a glove in which the multiple fastening points of the glove enhance the connection of the glove to the hand and the resistance bands coming from the finger tips allow the user to transfer force through the hand in an open or closed position.

Embodiments of the present invention comprise a glove with a connecting member (a ring) at the glove's palm and back for connecting the glove to a resistance device or exercise machine. One or more adjustment straps and retention bands attached to the fingers, provide a secure fit, and retain a finger connecting member therein. The finger connecting members form a loop, pass through a d-ring attached to each finger, and the loops attach to the ring. The ends of the connecting members are attached near the finger tip, which is covered by a cap. An adjustable cuff near the wrist enables the user to fasten the glove securely. When connected to a resistance device or exercise machine, the glove helps to increase connectivity and transfer force through the hands and fingers.

BRIEF DESCRIPTION OF THE SEVERAL VIEWS OF THE DRAWING

FIG. 1 is a schematic representation of an embodiment of the present invention, in which

DETAILED DESCRIPTION OF THE INVENTION

Embodiments of the present invention comprise a glove 100 with a connecting mechanism 200 for attaching the glove 100 to an exercise device. For the purposes of the present specification, the term "exercise device" or "exercise machine" is intended to include both exercise machines as well as objects used in resistance training, such as a door, wall, fence, or another fixed object to which the present invention can be connected.

Figure 1A:
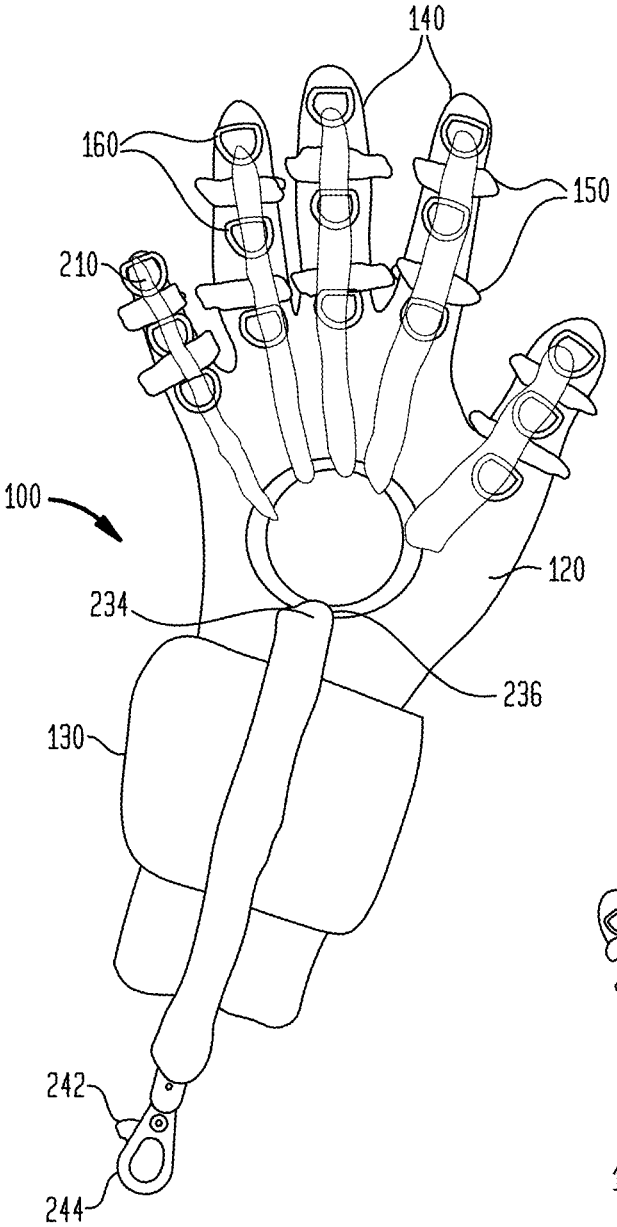
FIG. 1A is a view of the back of the present invention.
Figure 1B:
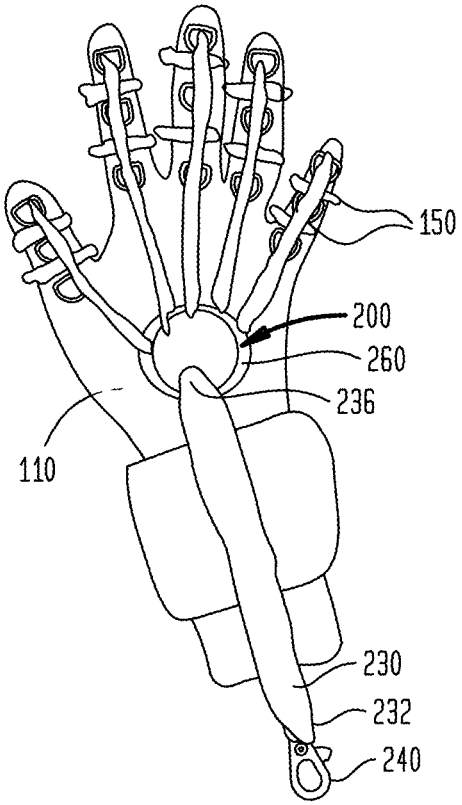
FIG. 1B is a view of the front of the present invention.
Figure 2:
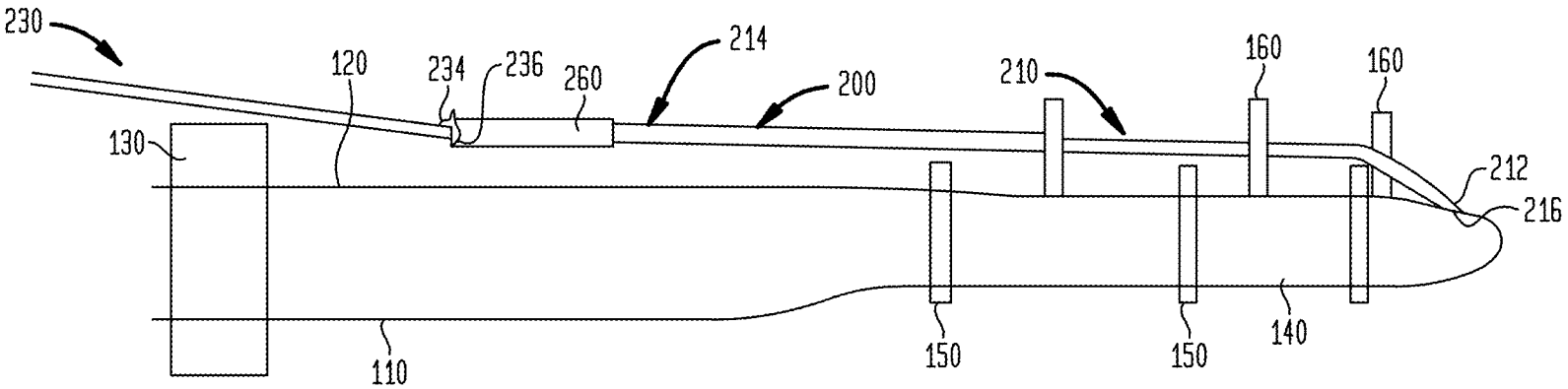
FIG. 2 is a side view, showing the connection of a finger connecting member with a finger tube and the ring, and the connection of the ring with the device attachment member.

FIGS. 1-2 illustrate a glove embodiment designed to be worn on the left hand. Embodiments of the present invention can also be manufactured to be worn on the right hand (FIG. 3), or an ambidextrous embodiment that can fit either the left hand or the right hand.

Embodiments of the present invention may include one or more connecting mechanisms 200, an embodiment in which there is a connecting mechanism 200 attached to the palm 110 of the glove only, an embodiment in which the connecting mechanism 200 attached to the back 120 of the glove only, or an embodiment in which there is a connecting mechanism 200 attached to the palm 110 and the back 120 of the glove. The embodiment shown in the drawings includes a connecting mechanism 200 attached to the palm 110 and the back 120 of the glove.

The glove 100 can be a commercially available glove, or custom manufactured, and which includes an adjustable cuff 130 at the bottom region of the glove body to enable the user (also referred to as a trainee) to fasten the glove 100 securely on their hand. In embodiments, the cuff 130 is a strip of a hook and loop fastener. The cuff 130 could also comprise a strap including a buckle at one end, and a plurality of openings towards the second end to secure the strap. The strap itself may be adjustable, and an alternate embodiment could include interlocking clasps to secure the glove. Generally, the glove 100 extends to the wrist of the user, and alternate embodiments may extend past the wrist.

The glove 100 comprises a body including the palm member 110 and the back member 120, and a plurality of finger tubes 140.

One or more adjustment straps 150 are attached to each finger tube 140 at or near the joints of each finger other than the thumb. On the thumb the adjustment straps 150 attach near the thumb's two main bones. The adjustment straps 150 are used to secure the finger tubes 140 to each finger, provide a secure fit, and to increase connectivity and appropriately transfer force through the hands and fingers. The adjustment straps 150 comprise a hook and loop fastener material. In alternate embodiments, the adjustment straps 150 could be an elastic band, either sewn into the finger tubes or externally fastened thereto.

One or more d-rings 160 are attached to both the palm side and the back side of each finger tube (see FIGS. 1-2). On the palm side of the glove body, the d-ring 160 is attached below the bottom of the finger tube, and on the back side of the glove body the d-ring 160 is attached in a similar position, near where the finger joins the back of the hand. The d-rings 160 function as guides through which a finger connecting member 210 passes, the finger connecting members 210 including a first end 212 and a second end 214 (see side view in FIG. 2).

On each finger, the first end 212 is attached to the palm side and the back side of each finger tube, by means of stitching 216 or a fastener such as an adhesive. The finger connecting members 210 can be a rope, elastic, a stretch fabric, or a high strength rope material such as a KEVLAR® (Registered trademark of DuPont Safety & Construction, Inc., Wilmington, DE) or comparable material. Depending upon the material which the finger connecting members 210 are made, second end 214 may comprise a hole, or may be a loop formed by folding the connecting member over and attachment of an end to the remaining portion of the connecting member 210.

The second end 212 of the finger connecting members 210 is slidably attached to ring 260, to which an end of both the device connecting member 230 and each of the finger connecting members 210 are slidably attached.

The length of the finger connecting members 210 varies, the length of those for the three middle fingers being longer than those for the pinky or the thumb. In alternate embodiments, the finger tubes 140 can be open; such construction, however, may not be as effective as the embodiment shown in the figures, because it is thought that using closed finger tubes will transfer more resistance to the fingers and hand than an embodiment with open finger tubes. In embodiments, the palm of the glove and/or the palm side of the fingers of the glove could include a layer of padding material for additional comfort and/or protection.

The ring 260 can be either a solid ring, or a split ring of the type commonly used for key rings, for receiving an end of the connecting member. The ring 260 could also be a ring containing an opening mechanism, which when closed, forms a ring around which the connecting members can move freely. As shown in the drawings, ring 260 has a generally circular shape. However, ring 260 could also have an oval or elliptical shape, or triangular, rectangular, hexagonal or other configuration.

As shown in FIGS. 1-2, device attachment member 230 has a first end 232 for attachment to an exercise device. A fastener 240 attached to the first end 232 is used to join the attachment member 220 with the exercise device. In the example shown, fastener 240 is a push-button clasp, wherein when push-button 240 is depressed, prong 242 is pushed out of engagement with the clasp ring 244, opening the clasp 240 and enabling it to engage the exercise device. Second end 234 includes a loop 236 which is slidably attached to ring 260. The device connecting members 230 can be a rope, cable, elastic strap, or similarly functional material. Fastener 240 can be a carabiner, a clasp, hook and eye member, a buckle, a turnbuckle or other types of fasteners known to those skilled in the art.

Figure 3:
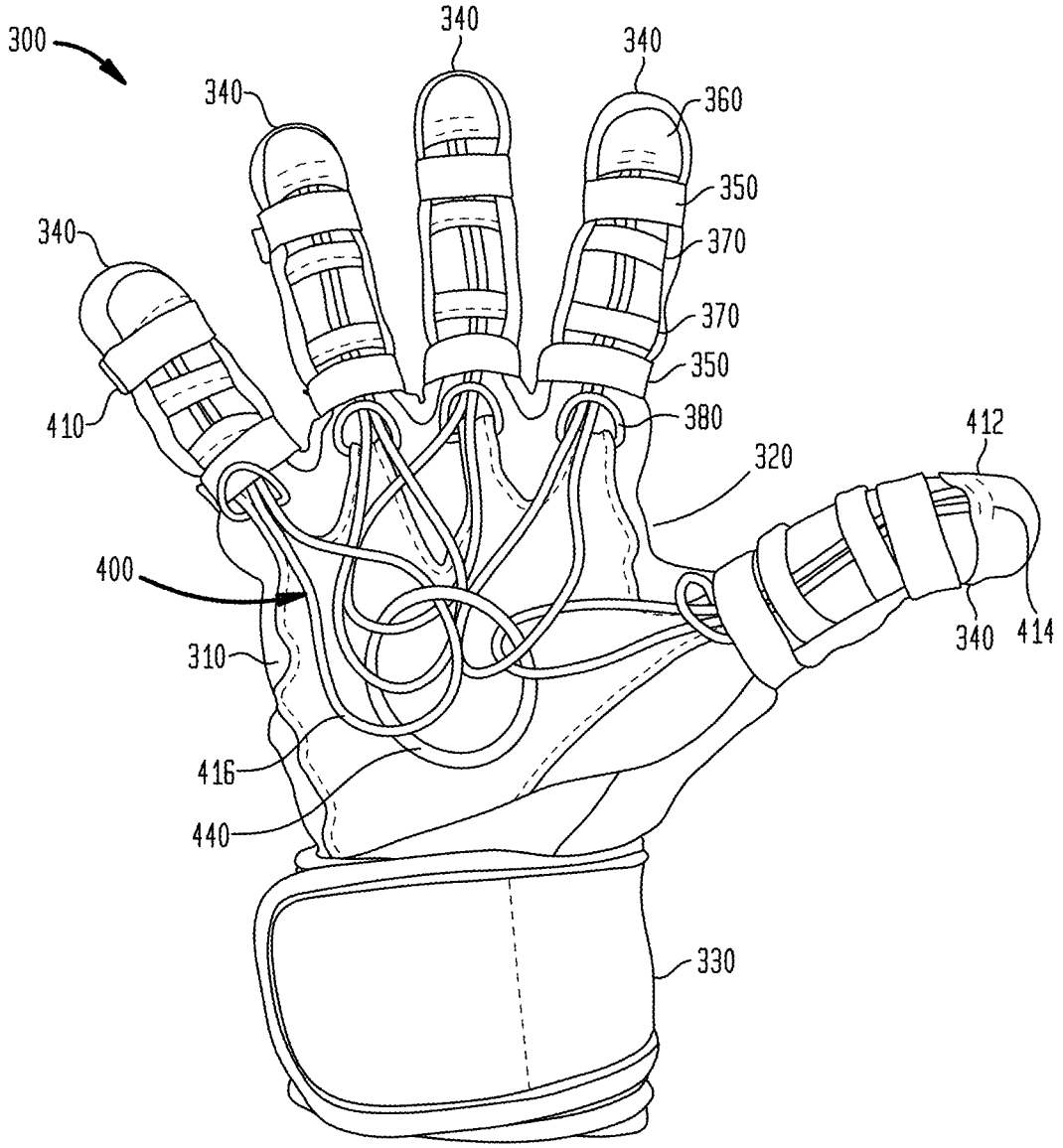
FIG. 3 shows palm-side view of an alternative embodiment of the present invention. The embodiment illustrated is for use on the right hand.
Figure 4:
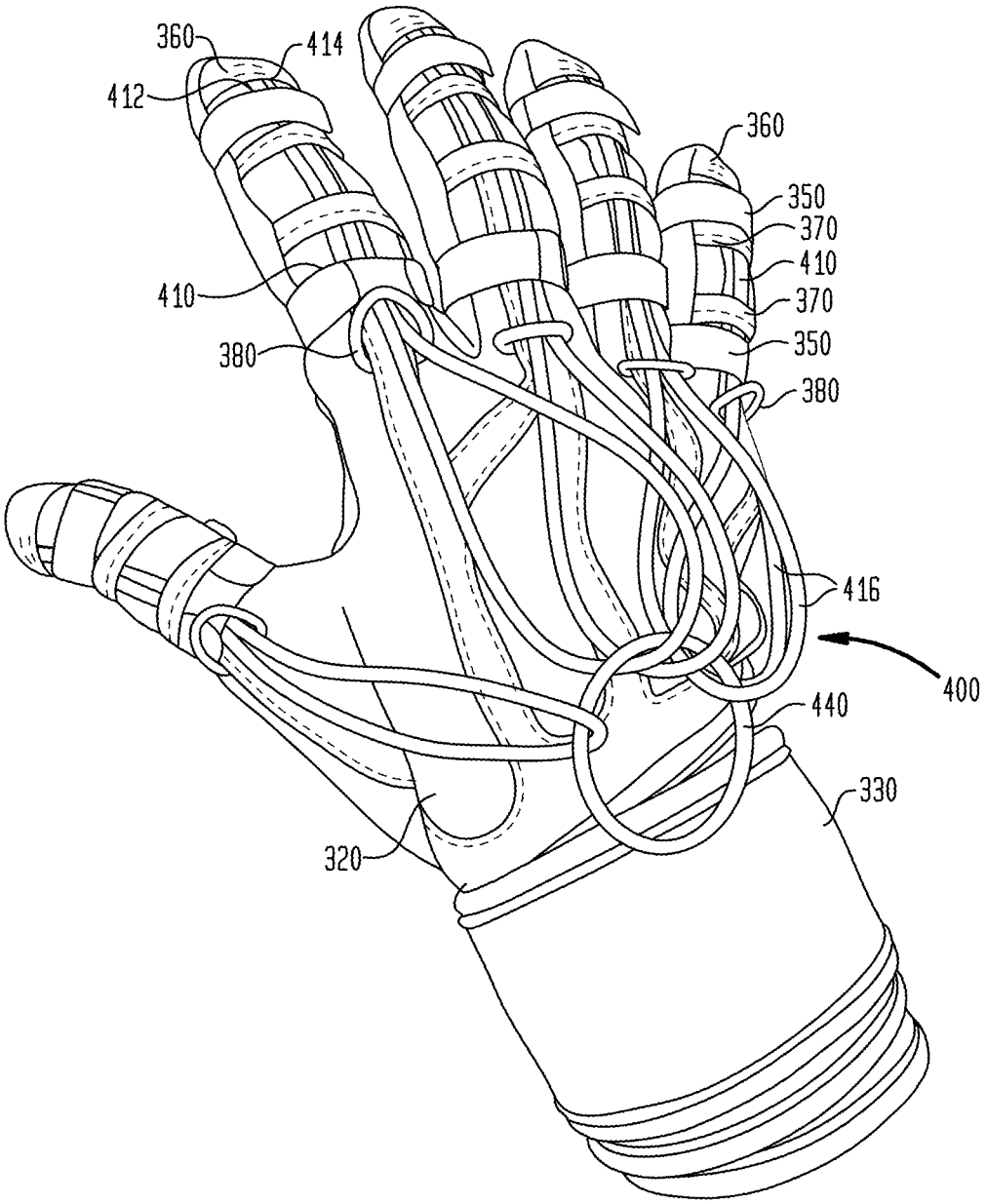
FIG. 4 is a back side view of the embodiment of FIG. 3.

FIGS. 3-4 illustrate an alternate embodiment of the present invention, in this embodiment illustrating a glove 300 for use on the right hand.

Embodiments of the present invention may include one or more attachment mechanisms 400, an embodiment in which there is an attachment mechanism 400 on the palm 310 of the glove only, an embodiment in which the attachment mechanism 400 is on the back 320 of the glove only, or an embodiment in which there is an attachment mechanism 400 on the palm 310 and the back 320 of the glove. The embodiment shown in the drawings includes an attachment mechanism 400 on the palm 310 and the back 320 of the glove.

The glove 300 can be a commercially available glove, or custom manufactured, and which includes an adjustable cuff 330 at the bottom region of the glove body to enable the user (also referred to as a trainee) to fasten the glove 300 securely on their hand. In embodiments, the cuff 330 is a strip of a hook and loop fastener. The cuff 330 could also comprise a strap, similar to a belt, including a buckle at one end and a plurality of openings towards the second end to interact with the buckle and secure the strap. Generally, the glove 300 extends to the wrist of the user, and alternate embodiments may extend past the wrist.

The glove 300 comprises a body including the palm member 310 and the back member 320, and a plurality of finger tubes 340. The palm member 310, back member 320, and the finger tubes 340 are joined together to form the body. The method of joining these members is dependent upon the materials used and manufacturing processes, and may include sewing, use of adhesives, ultrasonic welding, or other means known to those skilled in the art. In alternate embodiments, the finger tubes may be formed as a component of the palm member and the back member prior to joining to form the glove body. At the bottom, the glove body is open for receiving the hand and fingers of a user.

One or more adjustment straps 350 are attached to each finger tube 340 at or near the joints of each finger. The adjustment straps 350 are used to secure the finger tubes 340 to each finger, provide a secure fit, and to increase connectivity and appropriately transfer force through the hands and fingers. The adjustment straps 350 comprise a hook and loop fastener material. In alternate embodiments, the adjustment straps 350 could be an elastic band, either sewn into the finger tubes or externally fastened thereto.

One or more retention bands 370 are attached to each finger tube. As will be described below, the retention bands 370 aid in the positioning of the finger connecting members 410.

A d-ring 380 is attached to the palm side and the back side of each finger tube (see FIGS. 3-4). On the palm side of the glove body, the d-ring 380 is attached below the bottom of the finger tube, and on the back side of the glove body the d-ring 380 is attached in a similar position, near where the finger joins the back of the hand. The d-rings 380 function as guides through which a finger connecting member 410 passes, the finger connecting members 410 including a first end 412 and a second end 414.

On each finger, the first end 412 is attached to either or both the palm side and the back side of each finger tube, by means of stitching (not shown) or a fastener such as an adhesive. The finger connecting members 410 can be a rope, elastic, a stretch fabric, or a high strength rope material such as a KEVLAR® (Registered trademark of DuPont Safety & Construction, Inc., Wilmington, DE) or comparable material. A loop 416 is formed in each finger connecting member, and the second end 414 is attached proximate the connecting member first end 412, where they are covered by a cap 360. Each finger connecting member 410 is slidably retained by the adjustment straps 350 and the retention bands 370. The cap 360, the retention bands 370 and the adjustment straps 350 are attached by stitching (not shown) to the finger tubes 340. The fit of the adjustment straps 350 is made using a hook and loop fastener (shown on the glove back member, FIG. 4).

The loop 416 of each of the finger connecting members 410 is slidably attached to ring 440.

The length of the finger connecting members 410 varies, the length of those for the three middle fingers being longer than that for the pinky or the thumb. In an alternative embodiment the finger tubes 340 can be open, providing for exposed finger tips. Such construction, however, may not be as effective as the embodiment shown in the figures, because it is thought that using closed finger tubes will transfer more resistance to the fingers and hand than an embodiment with open finger tubes. Also, such alternate embodiment will require the use of shorter finger connecting members 410, the absence of cap 360 and possible loss of an adjustment band and a retention band 370 to provide a glove with exposed finger tips.

In embodiments, the palm of the glove and/or the palm side of the finger tubes 340 could include a layer of padding material for additional comfort and/or protection. Examples of a padding material include a fabric, a foam, cotton, or other materials.

The ring 440 can be either a solid ring, or a split ring of the type commonly used for key rings, for receiving an end of the connecting member. The ring 440 could also be a ring that is used to hold loose-leaf paper, containing an opening mechanism, which when closed, forms a ring, around which the loops 416 of the finger connecting members can move freely. As shown in the drawings, ring 440 has a generally circular shape. However, ring 440 could also have an oval or elliptical shape, or triangular, rectangular, hexagonal or other configuration.

Figure 5:
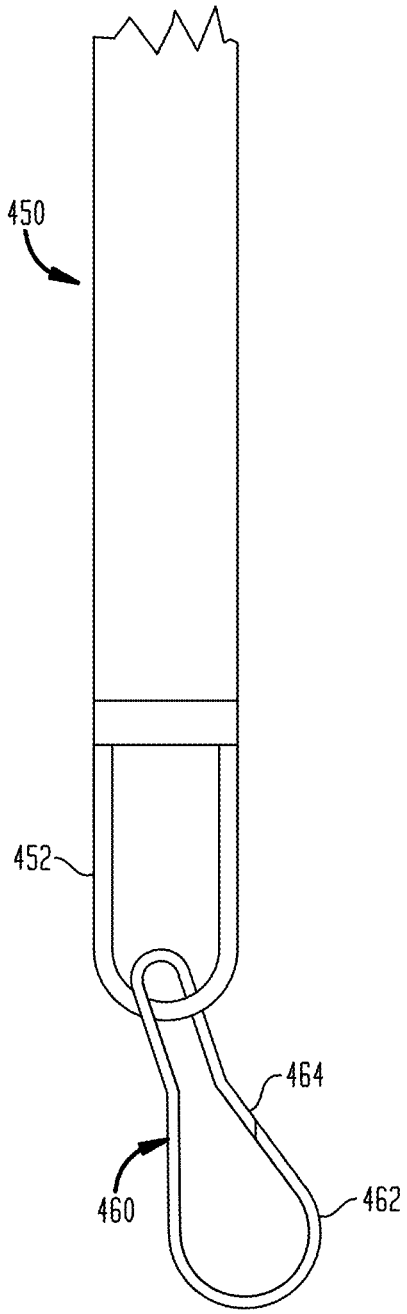
FIG. 5 is a fragmentary view of a resistance band; only a portion of the resistance band is shown because the connector is identical on both ends of the resistance band.

As shown in FIG. 5, a resistance band 450 has a first end 452 to receive a fastener, and for connection to an exercise glove embodiment. A fastener 460 is attached to the first end 452 for connecting the resistance band. In the example shown, fastener 460 is a carabiner with a base member 462, wherein when prong 464 is depressed, prong 464 is pushed out of engagement with a portion of the base member 462, opening the carabiner 460 and enabling it to engage the glove ring 440. The second end is identical to the first end, and not shown. The resistance band 450 can be a rope, cable, elastic strap, or similarly functional material. Fastener 460 can be a clasp, push button prong, hook and eye member, a buckle, a turnbuckle or other types of fasteners known to those skilled in the art.

In use, the user inserts a hand into the glove 300 with their fingers inserted into the finger tubes 340, and then tightens the finger adjustment straps 350 for a secure fit, followed by adjusting the cuff 330 to tighten the glove around the wrist. Ring 440 is then used to connect the glove 300 to the resistance band or exercise device. Removal of the glove after exercise is generally done in the reverse order. In some instances the user may prefer to secure the glove 300 to the particular resistance band or exercise device first, then put the glove on their hands. The use of multiple fastening points on the glove (ten on the fingers, and one on the wrist) enhance the connection of the glove to the hand and the resistance bands coming from the finger tips allow the user to transfer force through the hand, in either an open or closed position.

In the exercises described, the hands of the user are generally free to move independently of each other. In some instances the individual gloves may be joined to each other using an elastic band, similar to that shown in FIG. 7, which can be attached to the ring, generally the ring on the palm side of the glove. This elastic band can have a length up to about 18 inches or shorter, to keep the user's hands in close proximity to each other during exercises.

Explanation of Exercise Execution

With the exercise glove secured to the hand and an external resistance band attached to either the palm side attachment point or to the back of hand attachment point, the trainee (also referred to as the user) can perform a wide variety of exercises, ranging from dynamic movements, to static postures, or a variation of the two simultaneously. The list of exercises below is a non-exhaustive list of exercises that can be performed individually or in combination with one another.

The trainee may face toward, away from, or be side facing, and adjusts the height of the external resistance band mounting point. The trainee may have the external resistance band attached to either the palm side or the back side of hand, to both simultaneously, or a combination thereof to perform exercises such as, but not limited to, those listed below. The exercises may be a combination of multiple exercises together or a group of exercises performed one after another in rapid succession. For example, the trainee may have their feet in a lunge position while performing an overhead shoulder press or they may perform a horizontal pulling motion while in a neutral standing position.

During the execution of exercises the trainee may have their hands and fingers in a variety of positions. The hands and fingers have freedom of movement to be in an open or closed position, or any combination of the two while the hands and fingers are apart or touching one another. For example, the hands may be open and fingers abducted while moving the arms into horizontal shoulder abduction, or the index finger and thumb may be touching while performing a horizontal pushing motion.

Any combination of finger, hand, wrist, elbow, shoulder, spinal, hip, knee, ankle, foot, toe position or movement may be executed while facing toward, away from, or side facing and moving statically or dynamically with the external resistance band while it is adjusted to a desired height and attached to either the palm side or the back of hand side of the glove. Exercises can be performed bilaterally, unilaterally, contralaterally, ipsilaterally or any combination thereof.

Exercises

Standard Anatomical Position—Facing toward, away from, or side facing the external resistance band. Perform standard anatomical position by placing arms straight next to torso, palms facing forward, the external resistance band may be adjusted to desired height. Hold position and increase resistance by stepping away from the anchor point of the external resistance band.

Gait—Facing toward, away from, or side facing the external resistance band. Arms, hands, and fingers may be in any desired position, external resistance band may be adjusted to desired height. Perform gait/walking movement.

Squat—Facing toward, away from, or side facing the external resistance band. Arms, hands, and fingers may be in any desired position, external resistance band may be adjusted to desired height. Perform squatting movement by directing the hips back while simultaneously flexing at the hips, knees and ankles. Return to a standing position by extending through the ankles, knees, and hips.

Bend/Hinge—Facing toward, away from, or side facing the external resistance band. Arms, hands, and fingers may be in any desired position, external resistance band may be adjusted to desired height. Perform bending, hinging movement from standing, kneeling, lying, or seated positions or any other position or combination of positions.

Lunge—Facing toward, away from, or side facing the external resistance band. Arms, hands, and fingers may be in any desired position, external resistance band may be adjusted to desired height. Perform forward, reverse, or lateral lunge by stepping leg out forward, backward, or any degree laterally. Flex at the hips, knees, and ankles as the body descends toward the ground. Return to starting position by extending through the ankles, knees, and hips.

Torso Flexion/Extension/Rotation/Lateral Flexion—Facing toward, away from, or side facing the external resistance band. Arms, hands, and fingers may be in any desired position, external resistance band may be adjusted to desired height. Perform torso flexion, extension, rotation, lateral flexion movements or any combination of these movements from standing, kneeling, lying, or seated positions or any other position or combination of positions.

Horizontal Pull/Push—Facing toward, away from, or side facing the external resistance band. Arms, hands, and fingers may be in any desired position, external resistance band may be adjusted to desired height. Perform horizontal pulling, pushing movements or any combination of these movements from standing, kneeling, lying, or seated positions or any other position or combination of positions.

Vertical Pull/Push—Facing toward, away from, or side facing the external resistance band. Arms, hands, and fingers may be in any desired position, external resistance band may be adjusted to desired height. Perform vertical pulling, pushing movements or any combination of these movements from standing, kneeling, lying, or seated positions or any other position or combination of positions.

Shoulder Flexion/Extension/Abduction/Adduction/Internal Rotation/External Rotation/Circumduction—Facing toward, away from, or side facing the external resistance band. Arms, hands, and fingers may be in any desired position, external resistance band may be adjusted to desired height. Perform shoulder flexion, extension, abduction, adduction, internal rotation, external rotation, circumduction movements or any combination of these movements from standing, kneeling, lying, or seated positions or any other position or combination of positions.

Neck Flexion/Extension/Rotation/Lateral Flexion—Facing toward, away from, or side facing the external resistance band. Arms, hands, and fingers may be in any desired position, external resistance band may be adjusted to desired height. Perform neck flexion, extension, rotation, lateral flexion movements or any combination of these movements from standing, kneeling, lying, or seated positions or any other position or combination of positions.

Elbow Flexion/Extension—Facing toward, away from, or side facing the external resistance band. Arms, hands, and fingers may be in any desired position, external resistance band may be adjusted to desired height. Perform elbow flexion, extension movements or any combination of these movements from standing, kneeling, lying, or seated positions or any other position or combination of positions.

Wrist Flexion/Extension/Pronation/Supination/Radial Deviation/Ulnar Deviation—Facing toward, away from, or side facing the external resistance band. Arms, hands, and fingers may be in any desired position, external resistance band may be adjusted to desired height. Perform wrist flexion, extension, pronation, supination, radial deviation, ulnar deviation movements or any combination of these movements from standing, kneeling, lying, or seated positions or any other position or combination of positions.

Hand Open/Close—Facing toward, away from, or side facing the external resistance band. Arms, hands, and fingers may be in any desired position, external resistance band may be adjusted to desired height. Perform hand open, close movements or any combination of these movements from standing, kneeling, lying, or seated positions or any other position or combination of positions.

Finger Flexion/Extension/Abduction/Adduction/Circumduction—Facing toward, away from, or side facing the external resistance band. Arms, hands, and fingers may be in any desired position, external resistance band may be adjusted to desired height. Perform finger flexion, extension, abduction, adduction, circumduction movements or any combination of these movements from standing, kneeling, lying, or seated positions or any other position or combination of positions.

Finger to Thumb (index, middle, ring, pinky)—Facing toward, away from, or side facing the external resistance band. Arms, hands, and fingers may be in any desired position, external resistance band may be adjusted to desired height. Perform thumb to finger movement, touching or holding thumb in connection with one or multiple fingers in any combination, from standing, kneeling, lying, or seated positions or any other position or combination of positions.

The order that the exercises above are listed is solely for purposes of illustration, and the user can perform any, all, or combinations of these exercises, and/or others that may not have been recited. The number of times a given exercise is repeated depends upon the individual user, and their particular needs and requirements.

Example 1

Figure 6A:
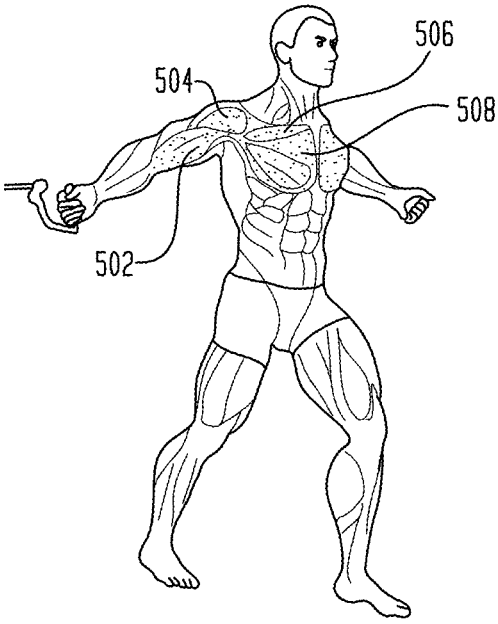
FIG. 6 illustrates the backward (FIG. 6A) and forward (FIG. 6B) position of the user, and the muscles involved, in the "chest fly" exercise.
Figure 6B:
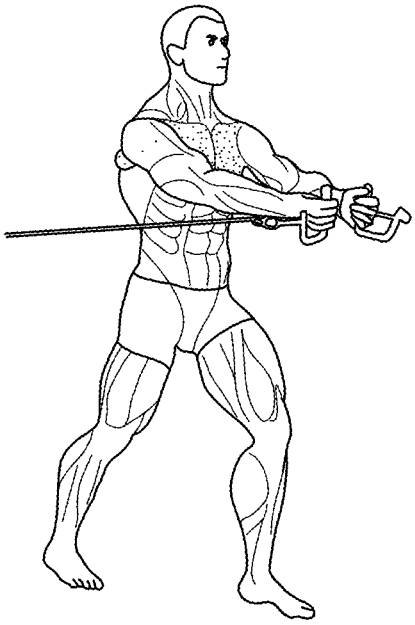

The chest fly exercise is designed to work the biceps brachi 502, anterior deltoid 504, and the upper (506) and lower 508 pectoralis major muscles, and FIG. 6 illustrates the backward (FIG. 6A) and forward (FIG. 6B) position of the user, and muscles involved, in the "chest fly" exercise. When embodiments of the present invention are worn, the exercise is done with the user's back facing the exercise machine.

Example 2

Figure 7A:
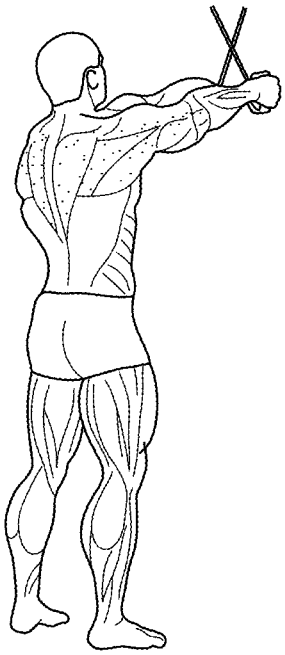
FIG. 7 illustrates the forward (FIG. A) and extended (FIG. 7B) position of the user, and the muscles involved, in the "reverse fly" exercise.
Figure 7B:
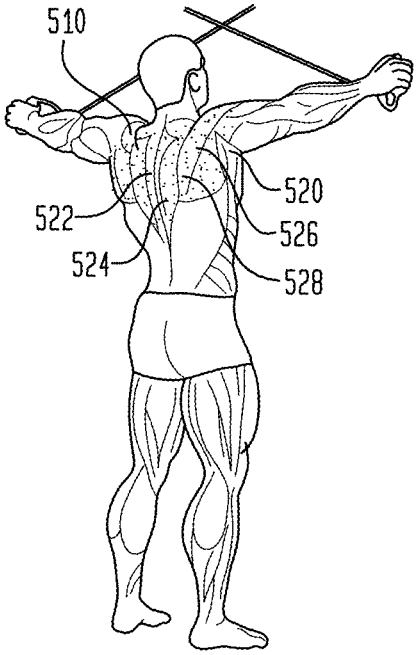

The reverse fly exercise is designed to work the lateral deltoid 510, posterior deltoid 520, rhomboid 522, middle and lower trapezius 524, teres minor 526 and infraspinatus 528 muscles, and FIG. 7 illustrates the forward (FIG. 7A) and extended (FIG. 7B) position of the user, and muscles involved, in the "reverse fly" exercise. When embodiments of the present invention are worn, the exercise is done with the user facing the exercise machine.

Although embodiments of this invention have been described with a certain degree of particularity, it is to be understood that the present disclosure has been made only by the way of illustration, and that numerous changes in construction and arrangement of parts may be resorted to without departing from the spirit and scope of the invention.

I claim:

1. A glove for use in exercising, the glove comprising:

a glove body comprising a palm side, a back side, a plurality of finger tubes, and a bottom region configured for receiving a hand of a user;

one or more retention bands surrounding each finger tube, each finger tube of the plurality of finger tubes, wherein each finger tube of the plurality of finger tubes terminates in a finger tip;

a plurality of finger connecting mechanisms, each finger connecting mechanism of the plurality of finger connecting mechanisms comprising a first end and a second end, the first end secured proximate to the finger tip by a cap attached to the finger tip;

each finger connecting mechanism of the plurality of finger connecting mechanisms is formed into a loop, and wherein the second end is secured proximate to the finger tip by the cap;

the finger connecting mechanism of the plurality of finger connecting mechanisms is slidably retained within the retention bands;

each finger connecting mechanism of the plurality of finger connecting mechanisms is attached to a respective finger tube on the palm side and back side of the glove body;

a ring to slidably receive the loop of each finger connecting mechanism of the finger connecting mechanisms; and an adjustable cuff attached to the glove body at the glove body bottom region, the adjustable cuff configured for encircling a wrist of the user and to secure the glove to the hand of the user.

2. The glove as described in claim 1, further comprising one or more adjustment straps surrounding each finger tube of the plurality of finger tubes, and wherein each finger connecting mechanism of the plurality of the connecting mechanisms is slidably retained within the one or more adjustment straps.

3. The glove as described in claim 2, further comprising a guide ring attached to each finger tube of the plurality of finger tubes, wherein each finger tube of the plurality of finger tubes is joined to the glove body, the guide ring is slidably retaining each finger connecting mechanism of the plurality of finger connecting mechanisms.

4. The glove as described in claim 3, wherein the guide ring is a D-ring.

5. The glove as described in claim 4, further comprising padding, and wherein the padding is attached inside the palm side of the glove body.

6. The glove as described in claim 1, wherein the adjustable cuff is a hook and loop fastener.

7. A glove for use in exercising, the glove comprising:

a glove body comprising a palm side, a back side, a plurality of finger tubes, each finger tube of the plurality of finger tubes terminating in a finger tip, and a bottom region configured for receiving a hand of a user;

one or more adjustment straps surrounding each finger tube of the plurality of finger tubes, a plurality of finger connecting mechanisms, each finger connecting mechanism of the plurality of finger connecting mechanisms comprising a first end and a second end, the first end secured proximate to the finger tip by a cap attached to the finger tip;

each finger connecting mechanism of the plurality of finger connecting mechanisms is formed into a loop, and wherein the second end is secured proximate to the finger tip by the cap;

one or more retention bands surrounding each finger tube of the plurality of finger tubes;

a guide ring attached to each finger tube of the plurality of finger tubes wherein each finger tube of the plurality of finger tubes is joined to the glove body; the guide ring, the adjustment straps and the retention bands slidably retaining each finger connecting mechanism of the finger connecting mechanism;

each finger connecting mechanism of the plurality of finger connecting mechanisms is attached to a respective finger tube of the plurality of finger tubes on the palm side and back side of the glove body;

a ring to slidably receive the loop of each finger connecting mechanisms of the finger connecting mechanisms and for connecting the glove to an exercise device; and an adjustable cuff attached to the bottom region of the glove body, wherein the adjustable cuff is configured for encircling a wrist of the user to secure the glove to the hand of the user.

8. The glove as described in claim 7, wherein the guide ring is a D-ring.

9. The glove as described in claim 7, wherein the adjustable cuff is a hook and loop fastener.

10. An exercise system, the system comprising:

an exercise glove, the exercise glove comprising:

a glove body comprising a palm side, a back side, a plurality of finger tubes, and a bottom region configured for receiving a hand of a user;

one or more retention bands surrounding each finger tube of the plurality of finger tubes, wherein each finger tube of the plurality of finger tubes terminates in a finger tip;

a plurality of finger connecting mechanisms, each finger connecting mechanism of the plurality of finger connecting mechanisms comprising a first end and a second end, the first end secured proximate to the finger tip by a cap attached to the finger tip;

each finger connecting mechanism of the plurality of finger connecting mechanisms is formed into a loop, and wherein the second end is secured proximate to the finger tip by the cap;

each finger connecting mechanism of the plurality of finger connecting mechanisms is slidably retained within the retention bands;

each finger connecting mechanisms of the plurality of finger connecting mechanisms is attached to a respective finger tube of the plurality of finger tubes on the palm side and back side of the glove body;

a ring to slidably receive the loop of each finger connecting mechanism of the finger connecting mechanisms; and an adjustable cuff attached to the bottom region of the glove body, wherein the adjustable cuff is configured for encircling a wrist of the user, to secure the glove to the hand of the user; and a resistance mechanism, the resistance mechanism having two ends, each end terminating in a fastener for connecting the resistance mechanism to the exercise glove.

11. The exercise system of claim 10, wherein the resistance mechanism is an elastic strap.

12. The exercise system as described in claim 11, wherein the fastener connects the resistance mechanism to the ring of the glove.

13. The exercise system as described in claim 11, further comprising a means for attaching the resistance mechanism to a rigid surface.

14. The exercise system of claim 10, wherein the fastener is selected from the group consisting of a carabiner, a clasp, a hook and eye member, a buckle and a turnbuckle.

* * * * *